US005884790A

United States Patent [19]

Seidita

[11] Patent Number: 5,884,790

[45] Date of Patent: Mar. 23, 1999

[54] CLOSURE CAP WITH BRAKING STRUCTURE

[75] Inventor: Thomas M. Seidita, Mechanicsville, Va.

[73] Assignee: Crown Cork & Seal Technologies Corporation, Alsip, Ill.

[21] Appl. No.: 961,538

[22] Filed: Oct. 30, 1997

[51] Int. Cl.[6] ..... B65D 41/04

[52] U.S. Cl. ..... 215/330; 215/252

[58] Field of Search ..... 215/330, 252

[56] References Cited

U.S. PATENT DOCUMENTS

| | | | |
|---|---|---|---|
| 3,435,978 | 4/1969 | Wittwer | 215/330 X |
| 3,610,454 | 10/1971 | Malick | 215/330 |
| 4,289,248 | 9/1981 | Lynn | 215/330 |
| 4,349,116 | 9/1982 | Luenser | 215/330 |
| 4,392,055 | 7/1983 | Whitney . | |
| 4,877,144 | 10/1989 | Thanisch | 215/330 |
| 4,948,001 | 8/1990 | Magly . | |
| 5,292,002 | 3/1994 | Narin | 215/330 |
| 5,462,186 | 10/1995 | Ladina et al. . | |

FOREIGN PATENT DOCUMENTS

| | | |
|---|---|---|
| 0 009 854 A1 | 4/1980 | European Pat. Off. . |
| 0 263 699 A2 | 4/1988 | European Pat. Off. . |
| 9112577 U | 1/1992 | Germany . |
| 986991 | 3/1965 | United Kingdom . |
| 2 275 047 | 8/1994 | United Kingdom . |
| WO 95/05322 | 2/1995 | WIPO . |
| WO 97/28057 | 8/1997 | WIPO . |

*Primary Examiner*—Stephen K. Cronin
*Attorney, Agent, or Firm*—Woodcock Washburn Kurtz Mackiewicz & Norris LLP

[57] ABSTRACT

A self-braking closure cap for a container, such as a soft drink container, of the type that has a threaded finish portion with at least one raised thread defined thereon includes a top wall portion and a side wall portion having a substantially cylindrical inner surface. The inner surface has at least one raised helically oriented thread defined thereon that has a predetermined pitch. Advantageously, a restrictor is provided for frictionally resisting unscrewing of the closure cap from a container finish portion by bearing primarily against one side of one of the raised threads of the finish portion. Since the braking is achieved by frictional engagement having a significant axial force component, instead of a radial force component, braking can be achieved with a minimum of radial force being exerted on the closure. This preserves the stripping torque value of the closure at an acceptable level without the need to add additional material to reinforce the closure against deformation.

7 Claims, 3 Drawing Sheets

CLOSURE CAP WITH BRAKING STRUCTURE

BACKGROUND OF THE INVENTION

1. Field of the Invention

This invention relates generally to finishes and closures for containers, such as carbonated beverage containers. More specifically, this invention relates to an improved closure that acts to providing a braking effect when the closure is unscrewed from the container, and does so with minimum effect on the stripping torque between the closure and the finish portion of the container.

2. Description of the Related Technology

Conventional mating closures and bottle finish structures for carbonated beverage containers typically utilize a screw type or threaded arrangement between the closure and the finish portion. These types of screw caps are mass manufactured by injection molding and have achieved commercial success mainly in the soft drink industry, where they are applied robotically to the finish portions of filled soft drink bottles on rapidly moving filling lines.

One constraint that exists in the design of conventional screw caps is that the screw connection between the cap and the thread of the finish portion must be able to withstand a definite amount of torque, which is in excess of the amount of torque that must be applied in order to ensure a sealed fit when the cap is installed onto the container after filling. This is known as the "stripping torque." Stripping torque is affected by a number of factors, including the rigidity of the cap's threads and the supporting outer wall of the cap. The thicker the outer wall, the greater the stripping torque will tend to be. Of course, material costs will rise significantly for the manufacturer as the thickness of the outer wall is increased.

Another important factor in the design of screw-type closure caps for carbonated bottles is that of ensuring that the connection between the cap and the finish portion of the container is properly vented so as to permit compressed gases from within the container to be released gradually as the cap is unscrewed by the consumer. To achieve this, it is common for the threads of finish portions of conventional soft drink containers to be intermittent, as opposed to a continuous helix. It is also common for the internal threads of the closure caps to have periodic gas venting gaps.

To ensure that the pressurized gases are relieved before the closure is removed from the container by a consumer, techniques have also been developed to retard or brake the unscrewing of the closure cap. FIG. 1 is a developed view of an inside surface of the cylindrical wall portion of one type of closure 10 that is in commercial use. Closure 10 includes an outer wall 12 that is shown projected as if it were flat, instead of being shaped substantially as an inside curved surface of a cylinder, as it is in use. As is common, closure 10 also includes a tamper-evident (TE) strip 14 having a number of ratchet teeth 16 about its lower periphery that are oriented so as to slip over a flange of the container finish portion during fastening of the closure, but to resist removal with sufficient force that, upon attempts at removal, a frangible score 18 between the TE strip 14 and the rest of the closure 10 will rupture first. Closure 10 also has threads 20 defined in the outer wall 12, and these threads 20 have periodic venting recesses 22 defined therein.

In the closure 10 that is depicted in FIG. 1, a braking effect is achieved by means of a so-called speed bump 24, which is a portion of the outer wall 12 that is slightly raised so as to extend radially inwardly toward the threads of the finish portion of the container. During removal of the closure by unscrewing, the speed bump 24 will frictionally engage the outermost surface of a thread on the finish portion, thus imparting some resistance to the unscrewing of the closure cap that will ensure that it will take several turns of the consumer's wrist to completely separate the closure from the container.

Although closure caps of the type depicted in FIG. 1 are effective to some extent, the radial force that is imparted by the engagement of the speed bump 24 with the thread of the container finish portion tends to deform the outer wall 12 of the closure 10 radially outwardly, away from the container finish. This effect substantially reduces the stripping torque value of the closure cap on a particular container finish. This problem can be mitigated somewhat by increasing the thickness, and thus the rigidity, of outer wall 10, but at the expense of greater material cost for the manufacturer.

A need exists for an improved closure cap having braking structure that will have a less profound effect on the stripping force value of the closure than closure caps with conventional braking structure.

SUMMARY OF THE INVENTION

It is accordingly an object of the invention to provide an improved closure cap having braking structure that will have a less profound effect on the stripping force value of the closure than closure caps with conventional braking structure. In order to achieve the above and other objects of the invention, a self-braking closure cap for a container, such as a soft drink container, of the type that has a threaded finish portion with at least one raised thread defined thereon includes a top wall portion, a side wall portion having a substantially cylindrical inner surface that has at least one raised helically oriented thread defined thereon that has a predetermined pitch; and restrictor structure for frictionally resisting unscrewing of said closure cap from a container finish portion by bearing primarily against one side of one of the raised threads of the finish portion, so that braking can be achieved with a minimum of radial force being exerted on the closure.

According to a second aspect of the invention, a method of removing a closure having internal raised threads from a container having a finish portion with external raised threads that are sized and pitched to mate with the internal raised threads of the closure includes steps of twisting the closure with respect to the container so that the internal raised threads begin to slide with respect to the external raised threads; frictionally resisting unscrewing of the closure cap from the container finish portion by causing an element to bear primarily against one side of one of the external raised threads, thereby braking the relative sliding motion of the internal and external threads; and continuing to unscrew the closure from the container until the internal raised threads disengage from the external raised threads.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
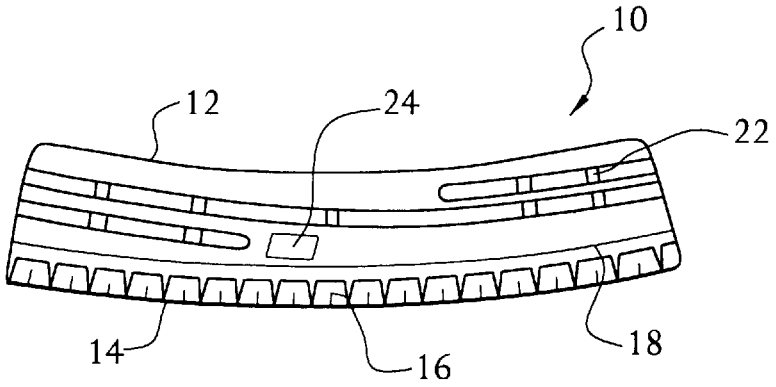
FIG. 1 is a developed view of an inside surface of the cylindrical wall portion of one type of closure that is in commercial use.
Figure 2:
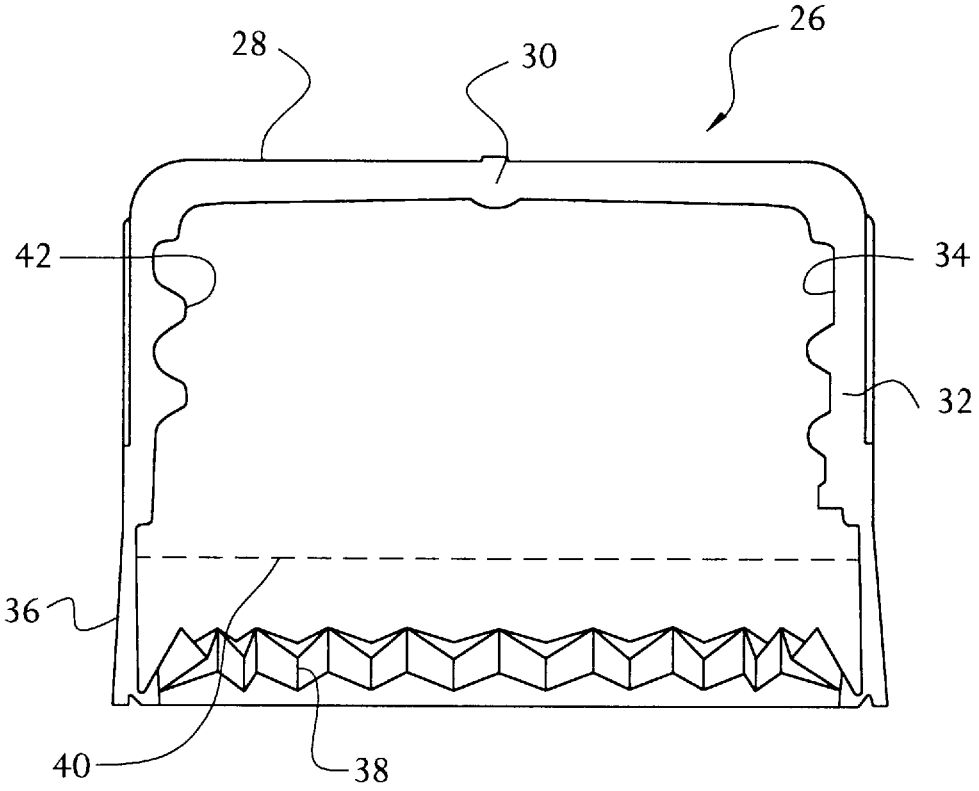
FIG. 2 is a cross-sectional view taken through a closure cap that is constructed according to a preferred embodiment of the invention.

Referring now to the drawings, wherein like reference numerals designate corresponding structure throughout the views, and referring in particular to FIG. 2, a closure cap 26 that is constructed according to a preferred embodiment of the invention includes an outer wall 28 that defines a top wall portion 30, a side wall portion 32 having a substantially cylindrical inner surface 34, and at least one internal raised helically oriented thread 42 having a leading edge 43, on the cylindrical inner surface 34.

Figure 3:
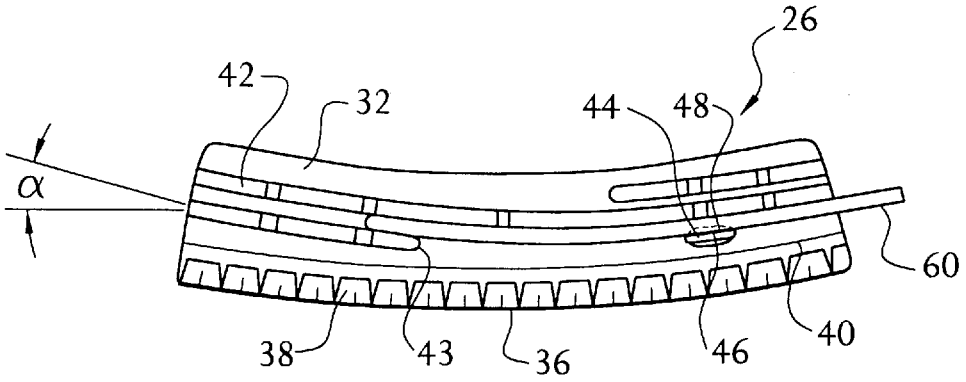
FIG. 3 is a developed view of an inside surface of the cylindrical wall portion of the closure cap that is shown in FIG. 2.

The thread 42 has a predetermined pitch a, as shown in FIG. 3, which is a developed view of the inner surface 34 that is shown projected as if it were flat, instead of being shaped substantially as an inside curved surface of a cylinder, as it is in use.

As is common, closure cap 26 also includes a tamper-evident (TE) strip 36 having a number of ratchet teeth 38 about its lower periphery that are oriented so as to slip over a flange of the container finish portion during fastening of the closure, but to resist removal with sufficient force that, upon attempts at removal, a frangible score 40 between the TE strip 36 and the rest of the closure cap 26 will rupture first.

Figure 4:
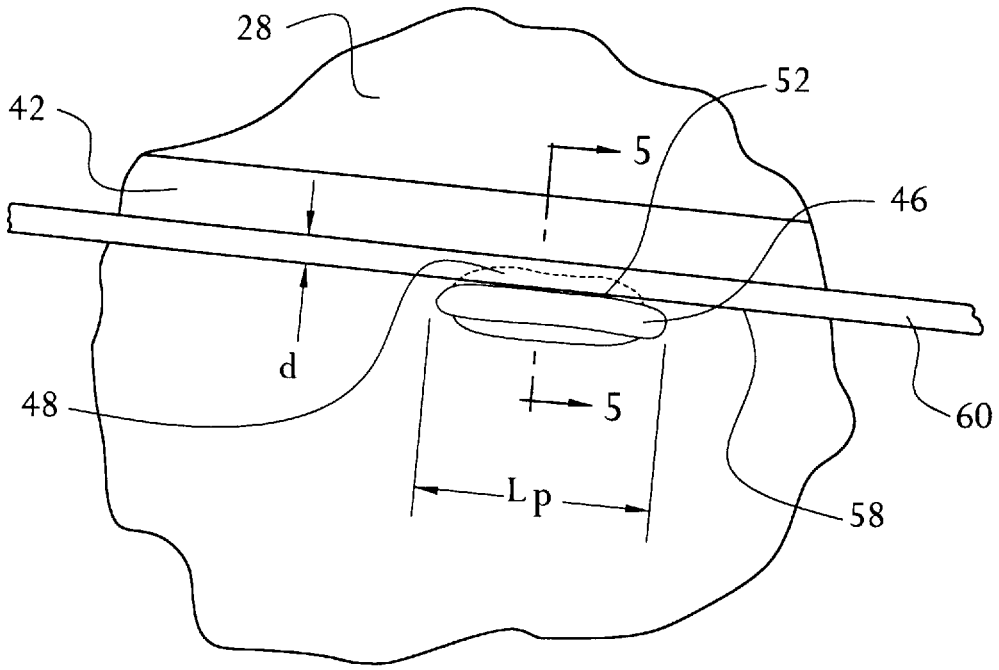
FIG. 4 is a blown-up fragmentary depiction of one small area that is also shown in FIG. 3.
Figure 5:
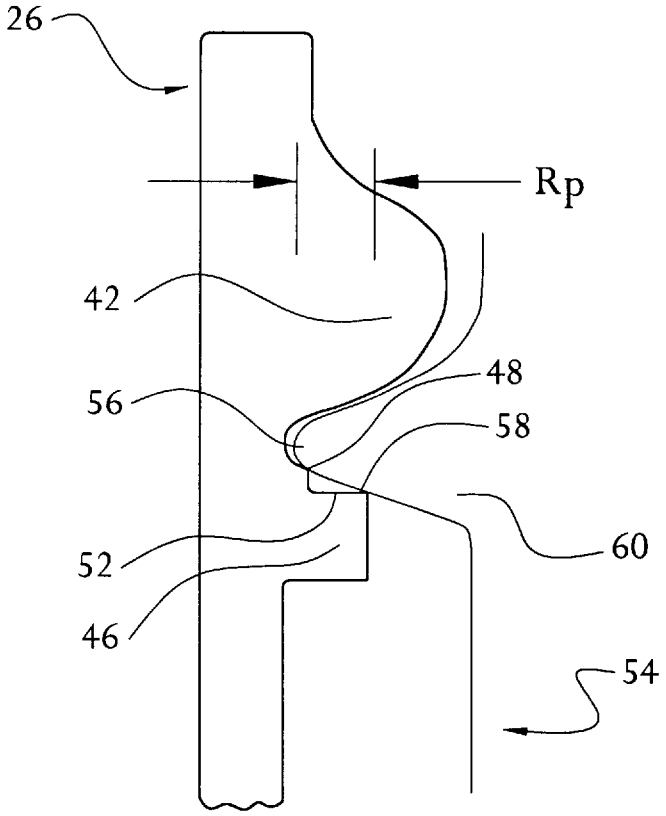
FIG. 5 is a partially diagrammatical cross-sectional view taken along line 5—5 in FIG. 4.

Looking now to FIGS. 3–5, one particularly advantageous aspect of the invention involves the provision of restrictor structure 44 positioned before the leading edge 43 of the helically oriented thread 42, of the for frictionally resisting unscrewing of the closure cap 26 from a container finish portion 54 by bearing primarily against one side surface 58 of one of the raised external threads 60 of the finish portion 54, so that braking can be achieved with a minimum of radial force being exerted on the closure. In the preferred embodiment, the restrictor structure 44 takes the form of a projection 46 that extends radially inwardly from the side wall portion 32 and that is positioned so as to be axially spaced from a projection of the predetermined pitch of the helically oriented thread 42 by a distance that is sufficient to bring one side 52 of the projection 46 to bear against a side 58 of one of the raised threads 60 of the finish portion 54 thereby interposing the raised thread 60 of the finish portion between the projection 46 and the projection of the helically oriented thread 42 of the closure cap during unscrewing of the closure cap. As may be seen in FIG. 4, this is preferably done by positioning the projection 46 so that its top side surface is positioned a distance d from the adjacent lower side surface of thread 42. In the preferred embodiment, distance d is within the range of 0.10 to 0.12 inches, and is preferably about 0.110 inches.

As may be seen in FIG. 5, projection 46 extends radially inwardly from the side wall portion 32 by a distance Rp that is within the range of about 0.025 inches to about 0.045 inches. More preferably, projection 46 extends radially inwardly from the side wall portion 32 by a distance Rp that is within the range of about 0.030 to about 0.040 inches. Most preferably, projection 46 extends radially inwardly from the side wall portion 32 by a distance Rp that is bout 0.035 inches. Projection 46 further has a length Lp, as shown in FIG. 4, that is within the range of about 0.20 to about 0.50 inches. More preferably, length Lp is within the range of 0.30 inches to about 0.40 inches. Most preferably, length Lp is about 0.34 inches.

As is further shown in FIG. 3 closure cap 26 further includes a speed bump 48 that is also positioned so as to extend radially inwardly from the side wall portion 32, by a distance Rs (dimension not shown). Speed bump 48 is distinguished from projection 46 in that the distance Rs by which it extends radially inwardly from the side wall portion 32 is substantially less than the distance Rp by which the projection 46 extends radially inwardly from the side wall portion 32. Distance Rs is preferably within the range of about 0.011 to about 0.023 inches. More preferably, distance Rs is within the range of about 0.015 to about 0.020 inches. Most preferably, distance Rs is about 0.017 inches. Projection 46 is also distinguished from speed bump 48 in that it is positioned to achieve braking by frictional engagement having a significant axial force component, as opposed to the speed bump 48, which achieves braking by frictional engagement that has a significant radial force component. In other words, the speed bump 48 is positioned to engage the outer surface 56 of the external thread 60 on the finish portion 54, whereas projection 46 is positioned to engage the side surface 58 of the external thread 60. In the preferred embodiment, speed bump 48 is integral with projection 46.

In operation, closure 26 is first placed on the container finish portion 54 by screwing to a predetermined torque. As torque is applied, the internal threads of the closure are not radially displaced from the external threads of the finish by the presence of the projection 46 as they would be by a speed bump having similar braking efficacy. Accordingly, a high strip torque value can be maintained without reinforcing the closure 26.

After it has been received by the consumer, the container is opened by first twisting the closure with respect to the container so that the internal raised threads begin to slide with respect to the external raised threads. During this process, unscrewing of the closure cap from the container finish portion is frictionally resisted by the projection 46 bearing primarily against one side of one of the external raised threads, thereby braking the relative sliding motion of the internal and external threads. As a result, the consumer will likely have to perform more than one twist to remove the closure from the container, giving pressurized gases from the container plenty of time to vent.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A self-braking closure cap for a container, the container having a threaded finish portion with at least one raised thread defined thereon, the cap comprising:

a top wall portion;

a side wall portion having a substantially cylindrical inner surface, said inner surface having at least one raised helically oriented thread defined thereon that has a predetermined pitch, said helically oriented thread having a leading edge; and restrictor means positioned before said leading edge of said helically oriented thread of said closure cap and axially spaced from a projection of said predetermined pitch of said helically oriented thread by a distance that is sufficient to cause said restrictor means to frictionally resist unscrewing of said closure cap from said threaded finish portion by interposing said raised thread of said finish portion between said restrictor means and said projection of said helically oriented thread of said closure cap, whereby braking can be achieved with a minimum of radial force being exerted on the closure.

2. A closure cap according to claim 1, further comprising a speed bump positioned to extend radially inwardly from said side wall portion and to bear primarily against an outer surface of said raised thread of said finish portion.

3. A closure cap according to claim 2 wherein said speed bump is integral with said restrictor means.

4. A closure cap according to claim 1, wherein said restrictor means comprises a projection that extends radially inwardly from said side wall portion by a distance that is within the range of about 0.025 inches to about 0.045 inches.

5. A closure cap according to claim 4, further comprising a speed bump positioned to extend radially inwardly from said side wall portion by a distance that is less than the distance that said projection extends and to bear primarily against an outer surface of said raised thread of said finish portion.

6. A closure cap according to claim 4, wherein said restrictor means comprises a projection that extends radially inwardly from said side wall portion by a distance that is within the range of about 0.030 inches to about 0.040 inches.

7. A closure cap according to claim 6, wherein said restrictor means comprises a projection that extends radially inwardly from said side wall portion by a distance that is about 0.034 inches.

* * * * *

UNITED STATES PATENT AND TRADEMARK OFFICE

CERTIFICATE OF CORRECTION

PATENT NO. : 5,884,790

DATED : March 23, 1999

INVENTOR(S) : Seidita

It is certified that error appears in the above-identified patent and that said Letters Patent is hereby corrected as shown below:

On the Title Page, item [56], delete "5,292,002 and insert --5,292,020-- therefor.
Column 1, Line 10, delete "acts to providing a " and insert --acts to provide a-- therefor.
Column 3, Line 21, delete "42 having a leading edge 43," and insert --42, having a leading edge 43,-- therefor.
Column 3, Line 23, delete "pitch a," and insert --pitch α,-- therefor.
Column 3, Line 39, delete "44 positioned before the " and insert --44, positioned before the -- therefor.
Column 3, Line 40, delete "of the for frictionally" and insert --for frictionally-- therefor.
Column 3, Line 52, delete "of the finish portion 54" and insert --of the finish portion 54,-- therefor.
Column 4, Line 2, delete "bout" and insert --about--therefor.

Signed and Sealed this

Twenty-third Day of November, 1999

*Attest:*

Q. TODD DICKINSON

*Attesting Officer*

*Acting Commissioner of Patents and Trademarks*